US009353947B2

(12) United States Patent
Krull

(10) Patent No.: US 9,353,947 B2
(45) Date of Patent: May 31, 2016

(54) COMBUSTOR FLASHBACK/FLAME HOLDING DETECTION VIA TEMPERATURE SENSING

(75) Inventor: Anthony Krull, Anderson, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 2088 days.

(21) Appl. No.: 12/482,898

(22) Filed: Jun. 11, 2009

(65) Prior Publication Data

US 2010/0318274 A1 Dec. 16, 2010

(51) Int. Cl.

| | |
|---|---|
| ***F23N 5/00*** | (2006.01) |
| ***F23N 5/02*** | (2006.01) |
| ***F23M 11/00*** | (2006.01) |
| ***F23N 5/10*** | (2006.01) |
| ***F23N 5/24*** | (2006.01) |
| *F23N 5/08* | (2006.01) |

(52) U.S. Cl.

CPC ..... *F23N 5/02* (2013.01); *F23M 11/00* (2013.01); *F23N 5/102* (2013.01); *F23N 5/242* (2013.01); *F23N 5/082* (2013.01); *F23N 2041/20* (2013.01)

(58) Field of Classification Search

CPC ..... F23N 5/245; F23N 5/003; F23N 5/242; F23N 5/10; F23N 5/102; F23N 5/02; F23N 5/022; F23R 3/286; F23R 3/34; F23R 3/343; F23R 3/50; F23M 11/00

USPC ..... 701/100, 102–103, 106–107; 123/406.11–406.12, 406.26–406.28, 123/406.45, 406.55, 435, 677–678; 431/18–19, 22–24; 60/737, 747

See application file for complete search history.

(56) References Cited

U.S. PATENT DOCUMENTS

| | | | | |
|---|---|---|---|---|
| 5,487,266 | A * | 1/1996 | Brown | 60/776 |
| 5,857,320 | A * | 1/1999 | Amos et al. | 60/776 |
| 6,026,644 | A * | 2/2000 | Ito et al. | 60/737 |
| 6,210,152 | B1 | 4/2001 | Haffner et al. | |
| 6,357,216 | B1 | 3/2002 | Scott et al. | |
| 6,429,020 | B1 | 8/2002 | Thornton et al. | |
| 7,281,382 | B2 * | 10/2007 | Plimpton et al. | 60/779 |
| 2006/0260316 | A1 * | 11/2006 | Stuttaford | 60/737 |
| 2007/0006596 | A1 | 1/2007 | Fujii | |
| 2008/0016877 | A1 | 1/2008 | Miller et al. | |
| 2008/0083228 | A1 * | 4/2008 | Myhre | 60/773 |
| 2010/0170217 | A1 * | 7/2010 | Kraemer et al. | 60/39.091 |
| 2010/0175384 | A1 * | 7/2010 | Kraemer et al. | 60/773 |
| 2010/0180604 | A1 * | 7/2010 | Kawai et al. | 60/778 |
| 2010/0280732 | A1 * | 11/2010 | Singh et al. | 701/100 |
| 2011/0016871 | A1 * | 1/2011 | Kraemer et al. | 60/772 |
| 2011/0232296 | A1 * | 9/2011 | Frederick | 60/776 |
| 2012/0055663 | A1 * | 3/2012 | Onozawa et al. | 165/266 |

* cited by examiner

*Primary Examiner* — Jack W Keith
*Assistant Examiner* — Chuong P Nguyen
(74) *Attorney, Agent, or Firm* — Nixon & Vanderhye P.C.

(57) ABSTRACT

A combustor includes a combustor housing defining a combustion chamber having a plurality of combustion zones. A plurality of temperature detectors are disposed in communication with the combustion chamber. The plurality of temperature detectors detect a temperature in the plurality of combustion zones. A controller communicating with the plurality of temperature detectors is programmed to determine an occurrence of a flame holding condition or a flashback condition in the plurality of combustion zones based on signals from the plurality of temperature detectors.

9 Claims, 4 Drawing Sheets

COMBUSTOR FLASHBACK/FLAME HOLDING DETECTION VIA TEMPERATURE SENSING

BACKGROUND OF THE INVENTION

The invention relates to detecting combustor flashback/flame holding using a temperature sensor.

In a gas turbine, fuel is burned with compressed air, produced by a compressor, in one or more combustors having one or more fuel nozzles configured to provide a premixing of fuel and air in a premixing zone located upstream of a burning zone (main combustion zone). A gas-turbine combustor is essentially a device used for mixing large quantities of fuel and air and burning the resulting mixture. Gas-turbines with combustion systems designed to reduce NOx emissions to levels below 40 ppm without water or steam injection employ a combustion process in which fuel is uniformly mixed with air prior to the combustion process. In the premixing zone, ignition of the fuel and air occasionally occurs. This event, regardless of its cause, is called a "flashback." Due to the design of most premix systems, the combustion of fuel and air in the premix section usually causes considerable damage to components. For various reasons, it is often not practical to design a low NOx combustor to operate satisfactorily with a flame in the premix section.

Previously, flashback/flame holding had been prevented by having a flame holding margin and limiting the type of fuel that can be burned. Catastrophic damage to the fuel nozzles (and potentially any gas turbine hardware downstream) can be avoided by detecting the occurrence of flashback and by quickly taking remedial action. Additionally, with the use of a flashback detecting sensor, fuel flexibility can be enabled so that higher-order hydrocarbon fuels and/or fuels containing a portion of pure hydrogen can be burned.

BRIEF DESCRIPTION OF THE INVENTION

In an exemplary embodiment, a combustor includes a combustor housing defining a combustion chamber having a plurality of combustion zones. A plurality of temperature detectors are disposed in communication with the combustion chamber. The plurality of temperature detectors detect a temperature in the plurality of combustion zones. A controller communicating with the plurality of temperature detectors is programmed to determine an occurrence of a flame holding condition or a flashback condition in the plurality of combustion zones based on signals from the plurality of temperature detectors.

In another exemplary embodiment, a gas turbine includes a compressor configured to compress air, and the noted combustor in flow communication with the compressor. The combustor receives the compressed air from the compressor and combusts a fuel stream to generate a combustor exit gas stream.

In yet another exemplary embodiment, a combustor includes a premixing device that mixes fuel and air into a gaseous premix and introduces the gaseous premix into a combustion chamber; a plurality of temperature detectors communicating with the combustion chamber that monitor a temperature rise in the combustion chamber; and a controller communicating with the plurality of temperature detectors and being programmed to determine an occurrence of a flame holding condition or a flashback condition in the combustion zone based on signals from the plurality of temperature detectors. The plurality of temperature detectors are disposed in an orientation that monitors temperature upstream from the premixing device.

DETAILED DESCRIPTION OF THE INVENTION

Exemplary embodiments described herein include structure for detecting and remedying flashback/flame holding in a gas turbine fuel nozzle via temperature sensing provided by temperature sensors routed into and placed, for example, near the exit of the fuel nozzles. Monitoring flame/wall temperatures enables the detection of any abnormalities including flame-out or flashback. When flame holding/flashback is detected, it is desirable to take appropriate action and prevent damage to the gas turbine.

Figure 1:
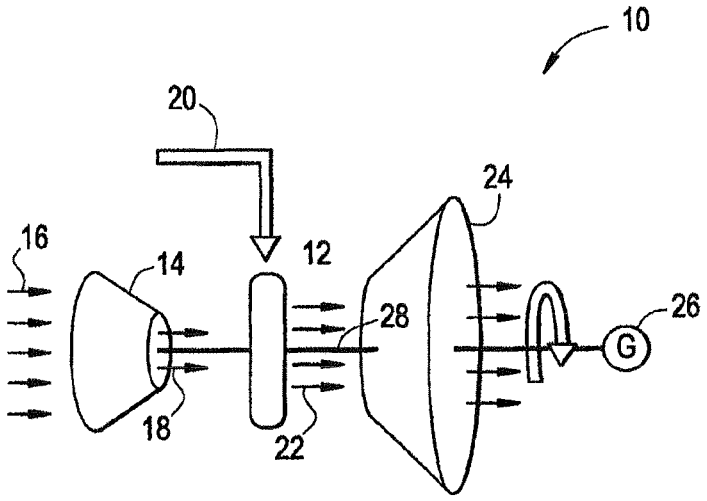
FIG. 1 is a schematic illustration of a gas turbine.

With reference to FIG. 1, a gas turbine 10 having a combustor 12 is illustrated. The gas turbine 10 includes a compressor 14 configured to compress ambient air 16. The combustor 12 is in flow communication with the compressor 14 and is configured to receive compressed air 18 from the compressor 14 and to combust a fuel stream 20 to generate a combustor exit gas stream 22. The gas turbine 10 includes a turbine 24 located downstream of the combustor 12, which is configured to expand the combustor exit gas stream 22 to drive an external load such as a generator 26. In the illustrated embodiment, the compressor 14 is driven by the power generated by the turbine 24 via a shaft 28. The combustor 12 employs a temperature detection device and controller configured to detect flame holding/flashback in a gas turbine combustion chamber and to take appropriate action to prevent damage to the gas turbine 10.

Figure 2:
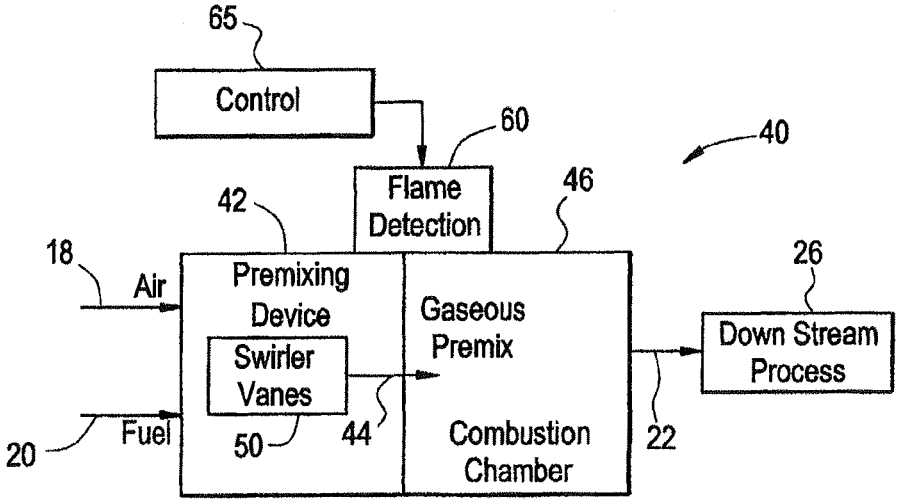
FIG. 2 is a schematic illustration of a combustor having a premixing device employed in the gas turbine system of FIG. 1.

FIG. 2 is a schematic illustration of an exemplary configuration 40 of the combustor 12 having a temperature detection device 60 employed in the gas turbine system 10 of FIG. 1. As illustrated, the combustor 40 includes a premixing device 42 configured to mix fuel 20 and air 18 to form a gaseous pre-mix 44. The combustor 40 includes a combustion chamber 46 configured to combust the pre-mix fuel 44 to form the combustor exit gas stream 22. The combustor exit gas stream 22 is directed to a downstream process 48 such as to the turbine 24 (see FIG. 1) for driving the external load 26 (see FIG. 1). The premixing device 42 can further include a plurality of swirler vanes 50 configured to provide a swirl movement to the fuel 20 and/or air 18 to facilitate mixing of the fuel 20 and air 18. In exemplary embodiments, the combustor 40 includes the temperature detection device 60, which can be coupled to and in communication with either or both of the premixing device 42 and the combustion chamber 46. The temperature detection device 60 can be any such device suitable for the described purpose, including, without limitation, a thermocouple, optical pyrometer, or via communication using fiber optics, etc.

The combustor 40 also includes a control unit 65 coupled to the temperature detector 60. The control unit 65 receives signals from the temperature detectors that correspond to the flame holding/flashback in the combustion chamber 46. The control unit 65 is further in communication with the source of the air 18 and the fuel 20. As further described herein, if the control unit 65 receives signals that indicate there is flame holding/flashback in the combustion chamber 46, the control unit 65 can take appropriate action to mitigate damage to the gas turbine. The appropriate action that the control unit 65 can take includes ceasing fuel and air flow to the combustion chamber or some modification of the air and fuel flow to reduce or eliminate the flame holding/flashback.

Figure 3:
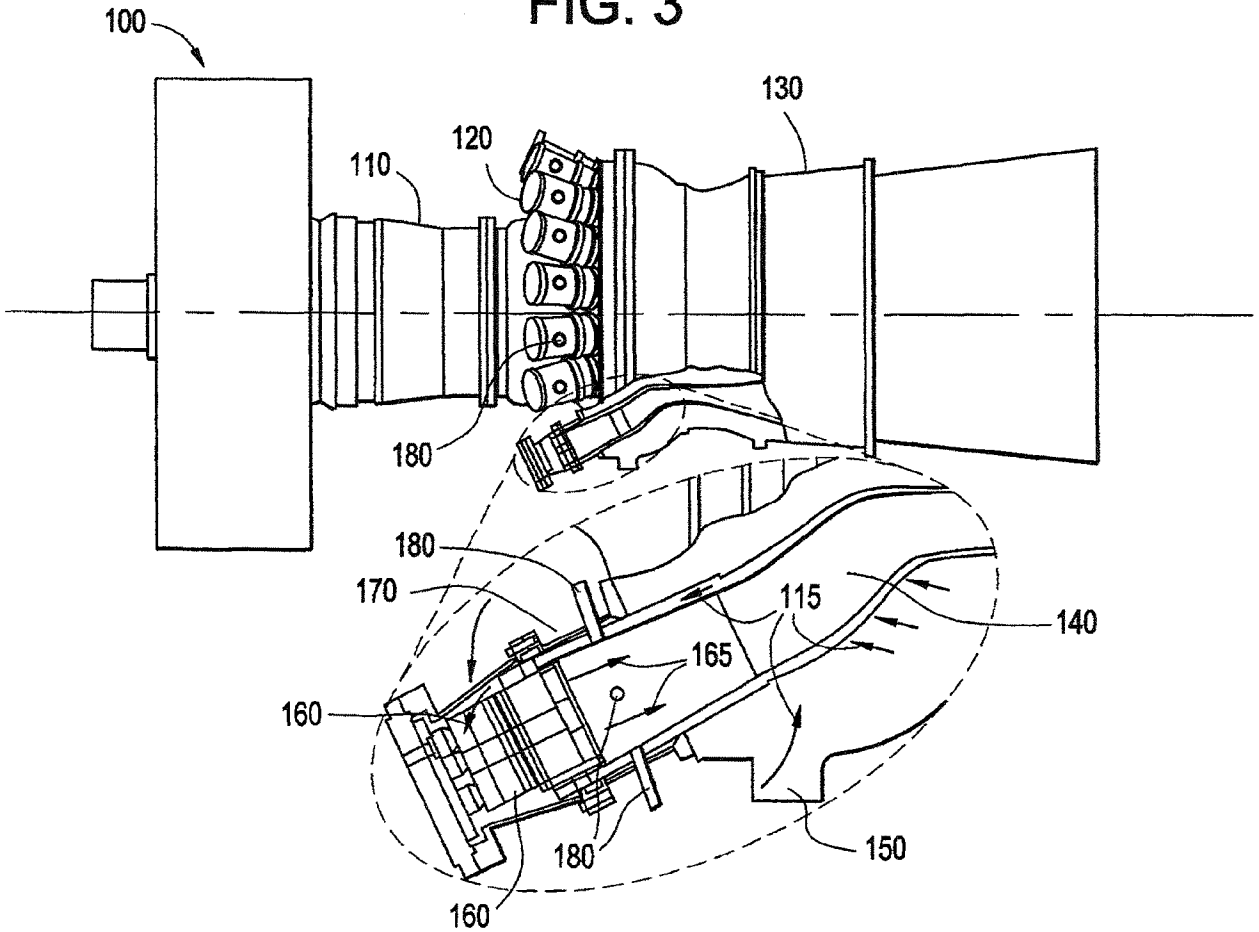
FIG. 3 is a side and sectional view showing pertinent parts of a combustor.

FIG. 3 illustrates an exemplary gas turbine 100 including a plurality of temperature detectors 180. The example of the gas turbine shows the temperature detectors coupled to and in communication with a combustion chamber 140 of the gas turbine and configured to detect temperatures within the combustion chamber 140.

Similar to FIG. 1, the gas turbine 100 includes a compressor 110 configured to compress ambient air. One or more combustor cans 120 are in flow communication with the compressor 110 via a diffuser 150. The combustor cans 120 are configured to receive compressed air 115 from the compressor 110 and to combust a fuel stream from fuel nozzles 160 to generate a combustor exit gas stream 165 that travels through a combustion chamber 140 to a turbine 130. The turbine 130 is configured to expand the combustor exit gas stream 165 to drive an external load. The combustor cans 120 include an external housing 170, which includes a series of temperature detectors 180 affixed to the housing 170. The temperature detectors 180 are coupled to and in communication with the combustion chamber 140 and the combustor exit gas stream 165.

The control unit 65 can detect the signal responses from multiple temperature detectors (e.g., the temperature detectors 180) and implement a voting algorithm to determine the type of action taken by the control unit 65 in response to a flame holding/flashback condition. For example, if two of the three detectors 180 determine that a flashback condition exists, the control unit 65 can then cut off or reduce the fuel to the combustor cans 120. Similarly, if only one detector 180 detects flashback, the control unit 65 can decide to continue the fuel until the detectors 180 make another reading. Multiple detector elements can reside in an enclosure corresponding to the detectors 180. The multiple detector elements can be multiplexed in order to aggregate the signals detected in the combustor cans 120. In this way, the aggregate signal can be implemented to determine the results of the voting algorithm.

Figure 4:
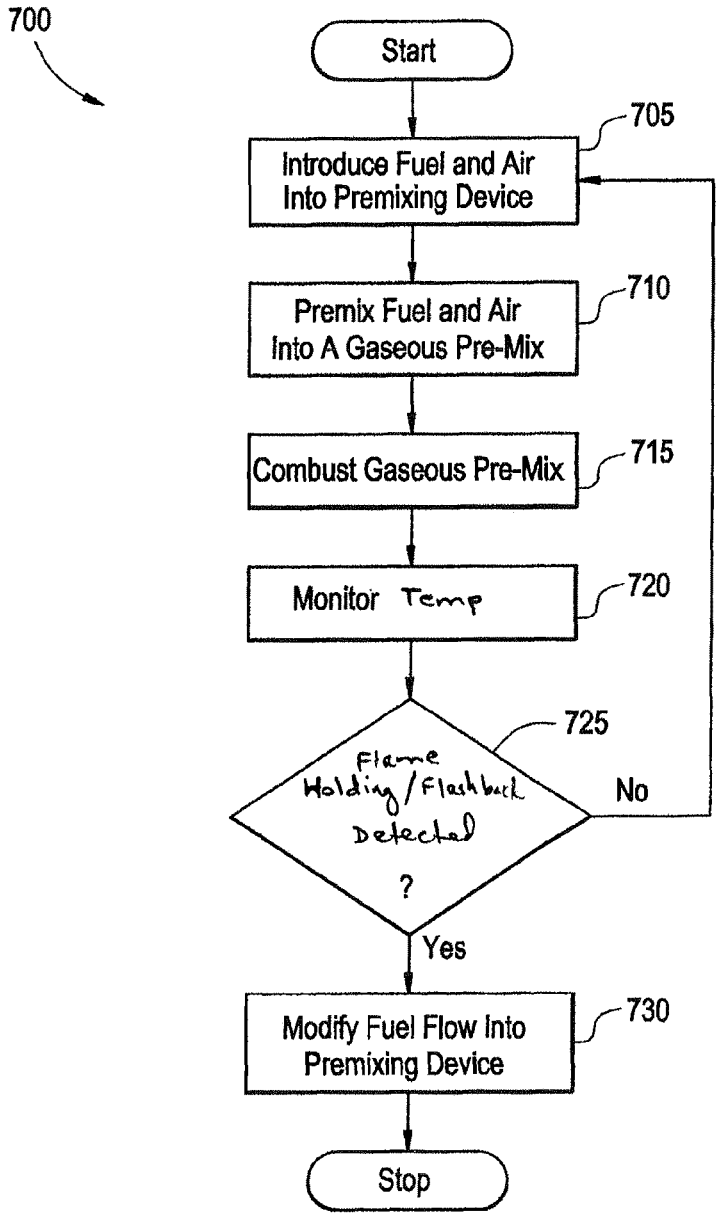
FIG. 4 is a flow chart showing a method for operating a combustor.

FIG. 4 is a flow chart showing a method 700 for operating a combustor in accordance with exemplary embodiments. At block 705, fuel nozzles (e.g., 160 FIG. 3) introduce fuel into a premixing device (e.g., 42 FIG. 2), and a compressor (e.g., 110 FIG. 3) introduces air into the premixing device. At block 710, the premixing device forms a gaseous pre-mix. At block 715, the combustor (e.g., combustor cans 120 FIG. 3) combust the premix in a combustion chamber (e.g., 165 FIG. 3). At block 720, the temperature within the combustion chamber is monitored. If the temperature detectors detect a condition that evidences flame holding/flashback (Yes in block 725), then at block 730, the controller can modify the fuel flow into the premixing device or other appropriate action described herein. If the temperature detectors do not detect such condition (No in block 725), then the process returns to block 705.

Figure 5:
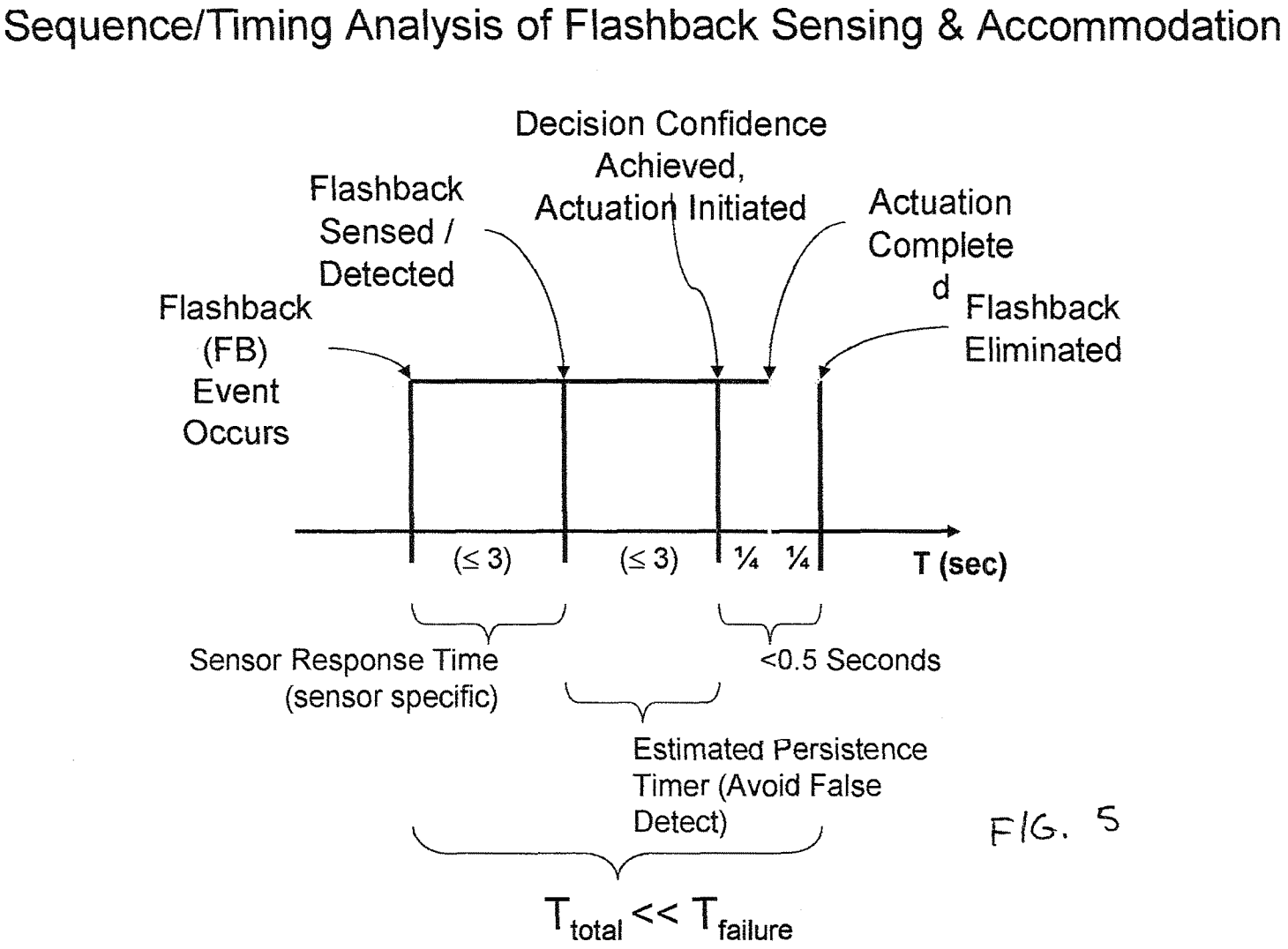
FIG. 5 is sequence/timing graph for desired flashback sensing and accommodation.

FIG. 5 is sequence/timing graph for desired flashback sensing and accommodation. Upon the occurrence of a flashback event, it is desirable for the sensors and controller to detect the event within three seconds and for the controller to take action within another three seconds. Mitigation actuation should take less than one-quarter second, and the flashback event should be eliminated within another quarter second. The values are exemplary and would be adjusted to assure that hardware damage and false alarms are avoided.

Exemplary embodiments have been described for detecting flame holding/flashback in the combustion chamber 140 of the combustor cans 120. Thermal emissions can be detected elsewhere in the system, for example from the fuel nozzles 160 (see FIG. 3). By monitoring the thermal emissions from the fuel nozzles 160, the system can determine if a flame is within the fuel nozzle 160 because the thermal emissions would indicate a higher temperature than would be expected in the fuel nozzles 160. Thermal emissions indicating flame holding/flashback could be measured at the swirler vanes, burner tube, or diffusion tip of the fuel nozzles 160 or other downstream components such as in the combustor. The temperature detectors 180 are preferably oriented adjacent the fuel nozzles 160 or fuel nozzle circuit. Fuel from the premixed circuit could be redirected in full or part to another fuel circuit, vented or to an unused fuel circuit such as the diffusion flame circuit. Furthermore, optical pyrometer detectors 180 could be spaced such that each detector 180 shares a line of sight with one of the fuel nozzles 160. As such, if two of the detectors indicate that there is a flame holding/flashback event, the control unit 65 therefore knows which of the fuel nozzles 160 is affected. In this way, the controller can selectively reduce the fuel or shut off the fuel to the one effected fuel nozzle 160. It is appreciated that the combustor can 120 can experience minimal disruption when the control unit 65 acts upon only a single fuel nozzle 160. As such, the affected fuel nozzle 160 can be serviced during the next scheduled outage.

By including strategically placed temperature sensors within a gas turbine, undesirable flame holding/flashback can be detected, and catastrophic damage to the fuel nozzles can be avoided by quickly taking remedial action. Additionally, with the detectors in place, fuel flexibility can be increased enabling the use of higher-order hydrocarbon fuels and/or fuels containing a portion of pure hydrogen without risking damage due to flame holding/flashback.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combustor comprising:

a combustor housing defining a combustion chamber having a plurality of combustion zones;

a plurality of temperature detectors affixed to the combustor housing and disposed in communication with the combustion chamber, the plurality of temperature detectors arranged to detect a temperature in the plurality of combustion zones; and a controller in communication with the plurality of temperature detectors, the controller being programmed to determine an occurrence of a flame holding condition or a flashback condition in at least one of the plurality of combustion zones based on signals from the plurality of temperature detectors.

2. A combustor according to claim 1, wherein the plurality of temperature detectors comprises at least one of thermocouples and optical pyrometers.

3. A combustor according to claim 1, further comprising a premixing device configured to mix fuel and air into a gaseous pre-mix upstream of the combustion chamber, wherein the controller is programmed to modify an amount of fuel supplied to the premixing device upon the determination of an occurrence of a flame holding condition or a flashback condition in at least one of the plurality of combustion zones.

4. A combustor according to claim 1, wherein the combustor housing comprises a plurality of fuel nozzles, and wherein a portion of the plurality of temperature detectors is disposed in the plurality of fuel nozzles and is configured to measure thermal emissions from the plurality of fuel nozzles.

5. A gas turbine comprising:

a compressor configured to compress air; and a combustor in flow communication with the compressor, the combustor configured to receive the compressed air from the compressor and configured to combust a fuel stream to generate a combustor exit gas stream, the combustor including:

a combustor housing defining a combustion chamber having a plurality of combustion zones;

a plurality of temperature detectors affixed to the combustor housing and disposed in communication with the combustion chamber, the plurality of temperature detectors arranged to detect a temperature in the plurality of combustion zones; and a controller in communication with the plurality of temperature detectors, the controller being programmed to determine an occurrence of a flame holding condition or a flashback condition in at least one of the plurality of combustion zones based on signals from the plurality of temperature detectors.

6. A gas turbine according to claim 5, wherein the plurality of temperature detectors comprises at least one of thermocouples and optical pyrometers.

7. A gas turbine according to claim 5, further comprising a premixing device configured to mix fuel and air into a gaseous pre-mix upstream of the combustion chamber, wherein the controller is programmed to modify an amount of fuel supplied to the premixing device upon the determination of an occurrence of a flame holding condition or a flashback condition in at least one of the plurality of combustion zones.

8. A gas turbine according to claim 5, wherein the combustor housing comprises a plurality of fuel nozzles, and wherein a portion the plurality of temperature detectors is disposed in the plurality of fuel nozzles and is configured to measure thermal emissions from the plurality of fuel nozzles.

9. A combustor comprising:

a combustion chamber having a combustion zone;

a premixing device configured to mix fuel and air into a gaseous premix and configured to introduce the gaseous premix into the combustion chamber;

a plurality of temperature detectors coupled to the combustion chamber and configured to communicate with the combustion chamber, the plurality of temperature detectors being configured to monitor a temperature rise in the combustion chamber; and a controller communicating with the plurality of temperature detectors, the controller being programmed to determine an occurrence of a flame holding condition or a flashback condition in the combustion zone based on signals from the plurality of temperature detectors, wherein the plurality of temperature detectors are disposed in an orientation that monitors temperature upstream from the premixing device.

* * * * *